US008474889B2

(12) United States Patent
Reifenberg et al.

(10) Patent No.: US 8,474,889 B2
(45) Date of Patent: Jul. 2, 2013

(54) DEVICE FOR ACTUATING A LOCK INTEGRATED IN A DOOR, HATCH, OR SIMILAR, ESPECIALLY IN A VEHICLE

(75) Inventors: Bernd Reifenberg, Essen (DE); Raimund Hübner, Wuppertal (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 1096 days.

(21) Appl. No.: 11/650,340

(22) Filed: Jan. 5, 2007

(65) Prior Publication Data

US 2007/0200369 A1 Aug. 30, 2007

Related U.S. Application Data

(63) Continuation of application No. PCT/EP2005/006738, filed on Jun. 22, 2005.

(30) Foreign Application Priority Data

Jul. 10, 2004 (DE) ..... 10 2004 033 518

(51) Int. Cl.
*E05B 3/00* (2006.01)

(52) U.S. Cl.
USPC ..... 292/336.3; 292/347; 292/DIG. 30; 292/DIG. 31

(58) Field of Classification Search
USPC ..... 292/336.3, 347, DIG. 30, DIG. 27, 292/DIG. 63, DIG. 31, 354, 348; 340/425.28, 340/545.7, 5.72
See application file for complete search history.

(56) References Cited

U.S. PATENT DOCUMENTS 6,079,767 A * 6/2000 Faubert et al. ..... 296/155
6,415,636 B1 * 7/2002 Fukumoto et al. ..... 70/208

(Continued)

FOREIGN PATENT DOCUMENTS

| | | |
|---|---|---|
| DE | 196 33 894 | 2/1998 |
| DE | 199 43 986 | 3/2001 |
| DE | 199 47 977 | 5/2001 |
| DE | 100 62 042 | 6/2002 |

(Continued)

*Primary Examiner* — Carlos Lugo
*Assistant Examiner* — Mark Williams
(74) *Attorney, Agent, or Firm* — Lucas & Mercanti, LLP; Klaus P. Stoffel

(57) ABSTRACT

A device for actuating a lock mounted in a door includes a handle with a bearing extension at one end, which can be installed from the exterior of the door in a bracket mounted in the interior of the door. A two-part electrical control unit has one control unit located in the handle and a second control unit in the vehicle. Electrical wiring with two sections, which are connected to each other by an electrical coupling part and a mating coupling part, extends between the two parts of the control unit. A receptacle for the electrical coupling part is provided in the bearing extension of the handle. The mating coupling part at the end of one section of wiring projects out through the opening in the exterior panel of the door and is fitted into the coupling part of the handle before the handle is installed. When the handle is to be installed, a common structural unit is available, composed of the handle, the coupling part, and the mating coupling part. When the handle is actuated as intended after installation, its pivot axis serves simultaneously as the axis of rotation for the coupling part and the mating coupling part, which are connected to each other.

6 Claims, 8 Drawing Sheets

U.S. PATENT DOCUMENTS 6,577,228 B1 * 6/2003 Tsuchida et al. ..... 340/5.72
7,018,214 B2 * 3/2006 Fukunaga et al. ..... 439/34
7,132,768 B2 * 11/2006 Ieda et al. ..... 307/652
7,140,653 B2 * 11/2006 Kobayashi et al. ..... 292/348
7,192,285 B2 * 3/2007 Makino et al. ..... 439/34
7,300,190 B2 * 11/2007 Nitawaki et al. ..... 362/501

FOREIGN PATENT DOCUMENTS

DE 102 32 583 2/2003
EP 1 108 834 6/2001

* cited by examiner

DEVICE FOR ACTUATING A LOCK INTEGRATED IN A DOOR, HATCH, OR SIMILAR, ESPECIALLY IN A VEHICLE

CROSS-REFERENCE TO RELATED APPLICATIONS

The present application is a continuation application of International application PCT/EP2005/006738, filed Jun. 22, 2005, which claims priority of DE 10 2004 033 518.4, filed Jul. 10, 2004, the priority of these applications is hereby claimed.

BACKGROUND OF THE INVENTION

1. Field of the Invention

The present invention relates to a device for actuating a lock installed in a door.

2. Description of the Related Art

The device includes a handle to be mounted on the exterior surface of the door. The handle has an extension at each end, each extension serving a different purpose. The one extension cooperates with a lock, whereas the other extension has bearing points and is therefore referred to in the following as the "bearing extension". A bracket with opposing bearing points for the bearing extension is mounted in the interior of the door. The handle is installed from the outside of the door. For this purpose, the exterior panel of the door has two openings, through which the two extensions of the handle can be inserted. The handle is then installed by a setting movement, in the course of which the bearing points of the handle travel into the opposing bearing points of the bracket.

So that the lock can be actuated conveniently, an electrical control unit is used, which is made up of two parts. This represents what is called the "convenience variant" of the device. Omitting the electrical control unit results in what is called the "standard design", in which comparable functions are implemented by mechanical means. In the case of the convenience variant, one of the control units is integrated into the handle, whereas the other control unit is located in the vehicle. The two control units are connected to each other by electrical wiring. The electrical wiring is divided into two sections, which are connected to each other by a two-part electrical coupling. At the end of one of the two sections of wiring there is a coupling part connected to the control unit, and at the end of the other section there is a mating coupling part connected to the other control unit in the vehicle. When the handle is installed, the coupling part and the mating coupling part must be connected to each other, and when the handle is removed, the two parts must be disconnected from each other. After the handle has been installed, the coupling parts are located in the area where the handle is mounted in its bearings and must therefore follow the pivoting movement of the handle when the handle is actuated.

DE 102 32 583 A1 shows a known device of the above-described type. A special coupling part is permanently mounted on the bearing extension of the handle described here and is electrically connected to a control unit in the handle. An associated mating coupling part is mounted in a defined angular position in the bracket by way of its own temporary axis of rotation and its own temporary mount for that axis. The handle with its mating coupling part is inserted into the coupling part of the bracket, and after insertion has been completed, it is pivoted toward the bracket. During this pivoting movement, the temporary rotational connection between the mating coupling part and the bracket is broken. After the pivoting movement, the handle is pushed in a direction parallel to the bracket, as a result of which a final axis of rotation on the handle is introduced into its final rotary bearing mount in the bracket. This final rotational mount then defines the rotational movement of the handle when it is actuated later to open the lock.

This known device requires specially designed coupling and mating coupling parts and temporary axes of rotation and axis of rotation mounts between the mating coupling part and the bracket. The handle, the bracket, the coupling part and the mating coupling part are designed specifically for a convenience device with electrical control and be can applied only to such a device. The device cannot be used for standard handles which do not have an electrical control unit, because the mating coupling part is a fixed component of the handle, without which the first phase of handle installation on the bracket is not even possible. The number of units which can be manufactured is therefore limited and the costs relatively high.

DE 100 62 042 A1 describes a device in which at least the mating coupling parts have their own rotary bearing points on the bracket. Here a radial element is supported pivotably on the bracket, and the mating coupling part is seated on the free end of this radial element.

In the device according to DE 196 33 894 C2, the mating coupling part is supported pivotably in a bearing block on the bracket. This pivot bearing of the coupling is aligned axially with the bearing points on the handle and the mating bearing points on the bracket, which are engaged with each other.

Finally, another variant of these devices is known from DE 199 47 977 C1. In this device, the mating coupling part is supported pivotably on a separate bearing in the bracket, and the coupling part is supported on the bearing extension of the handle.

In these known devices, additional components are required for the pivoting support of the mating coupling part on the bracket and possibly for the rotational support of the electrical coupling part on the handle. This requires complicated production and installation steps. These additional components also occupy valuable space. Because the coupling and the mating coupling parts are engaged during the installation of the handle in its bearings, the electrical contact is established invisibly behind the exterior panel of the door and therefore cannot be inspected. For this reason, the electrical contact may be defective.

SUMMARY OF THE INVENTION

The invention is based on the object of developing a simple, compact device of the previously described type with a coupling part and a mating coupling part which can be engaged reliably with each other and which, after they have been engaged, follow the movement of the handle as it is being actuated.

According to the invention, this object is met by a device for actuating a lock installed in a door, a hatch, etc., especially in a motor vehicle,

- with a manually actuatable handle on the exterior of the door, the handle having an extension (bearing extension 21) with bearing points at one end;
- with a bracket mounted in the interior of the door, the bracket being provided with mating bearing points for the bearing points of the handle;
- with a two-part electrical control unit for the lock, the one control unit being integrated into the handle and connected to the other control unit located in the vehicle by means of electrical wiring;

with a two-part electrical coupling located between two sections of the electrical wiring, the coupling consisting of a coupling part connected to the control unit on the handle side and a mating coupling part assigned to the other control unit on the vehicle side;

where the bearing extension of the handle can be inserted from the exterior of the door through an opening in the exterior panel of the door and its bearing points mounted in the mating bearing points of the bracket;

as a result of which the bearing points and the mating bearing points define a pivot axis in the bracket for actuation of the handle, this axis also being the axis of rotation for the two coupling parts, i.e., the coupling part and the mating coupling part, which are connected electrically to each other, wherein the bearing extension of the handle has a receptacle for the insertion of a loose electrical coupling part;

the receptacle and the coupling part have two complementary elements of a latch-type fastening, which, after the coupling part has been inserted, latch together and secure the loose coupling part in its inserted position in the handle;

the section of wiring with the mating coupling part hangs out of an opening in the exterior panel of the door;

the mating coupling part hanging on the end of the section of wiring is gripped manually and, before the handle is installed in the bracket, connected to the coupling part in the receptacle on the handle while still outside the bracket; where even before the installation of the handle, not only the handle and the coupling part inserted in the other handle but also the mating coupling part engaged with the coupling part already form a solid structural unit outside the bracket, the components of which unit can move together in common; and where this structural unit is installed as a whole in the bracket.

The following special meaning attaches to the measures of the invention.

In cases where the invention is to be used for the "convenience variant" with an electrical control unit, the electrical control unit is first installed in the handle. Then the coupling part seated on the associated section of wiring is inserted into the receptacle in the bearing extension. If the receptacle in the bearing extension of the handle is designed suitably for the insertion, if necessary, of the coupling part, a known coupling part already available according to the state of the art can be used. This means that the handle can also be used without a coupling part in a device of the previously mentioned "standard" type, which does not have an electrical control unit. It is therefore possible to use the handle and the bracket in the inventive device for either the convenience variant or for a standard device.

The electrical coupling part and mating coupling part can also be used to connect various other electrical conductors without additional effort, independently of the type of application in the inventive device. The reason that this is possible is that the mating coupling part is always a loose part, separate from the bracket, and therefore neither the mating coupling part nor the bracket must have any elements which engage with each other and which would therefore have to be brought into engagement before or during the installation of the handle. The bracket, in the invention, needs to have only a hole, out of which the section of wiring can hang and to the end of which the mating coupling part can be connected.

A special feature of the invention is that the handle has a receptacle in the area of the bearing extension into which the electrical coupling part is first inserted. This plug-in connection is secured by latching elements. The mating coupling part, however, hangs with its wiring section out of an opening in the exterior door panel. It is grasped by hand, and before the handle is installed in the bracket, that is, while the handle is still outside the bracket, the mating coupling part is fitted into the coupling part in the receptacle in the handle. According to the invention, a separate structural unit located outside the bracket is thus obtained, consisting of the handle, the coupling part inserted into the receptacle in the handle, and finally the mating coupling part, which has been fitted into the coupling part. This unit is fully assembled first and only then is it mounted in the bracket in the traditional manner, i.e., in the manner normally used for standard devices without an electrical control unit.

The completed unit formed by the handle, the inserted coupling part, and the engaged mating coupling part makes the installation process much easier, because it is accomplished outside the bracket on the visible side of the vehicle, where the installation process can be easily observed and reliably executed. There is no need to worry about establishing the connection between the coupling part and the mating coupling part during the installation process. The two parts are already integrated into the separate structural unit according to the invention and cannot be lost or come apart.

There is need to custom-manufacture the inventive bracket. The brackets which are used otherwise in the previously mentioned standard device with no electrical control can be used in the invention. When the bracket is used in the inventive device for the convenience variant, the only extra step required is to lay the wiring of the other control units in the vehicle along the bracket. The mating coupling part is attached to the end of this section of the wiring. Because the bracket can be used in two different ways, namely, for the convenience variant and for the standard design, both the handle and the bracket can be manufactured in much larger numbers. This lowers the cost of the production of the bracket and thus also decreases the overall costs of the inventive device.

The various features of novelty which characterize the invention are pointed out with particularity in the claims annexed to and forming a part of the disclosure. For a better understanding of the invention, its operating advantages, specific objects attained by its use, reference should be had to the descriptive matter in which there are illustrated and described preferred embodiments of the invention.

DETAILED DESCRIPTION OF THE INVENTION

Figure 1:
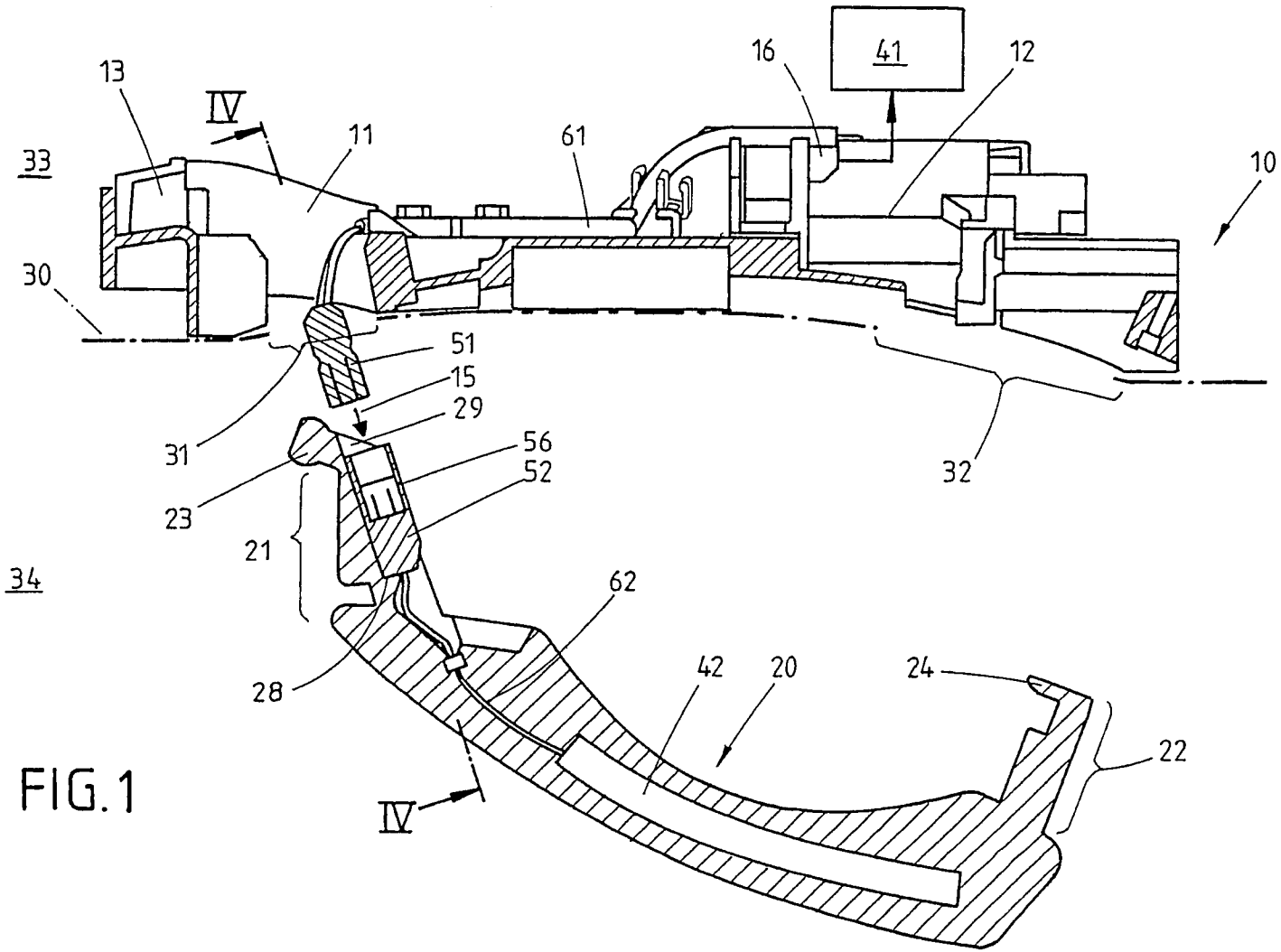
FIG. 1 shows a longitudinal cross section through a bracket attached to the interior of the door and through a handle, still separate from the bracket, the handle being located outside the exterior door panel indicated in dash-dot line, where the coupling part and the mating coupling part belonging to a two-part electrical control unit are still disconnected from each other.
Figure 8:
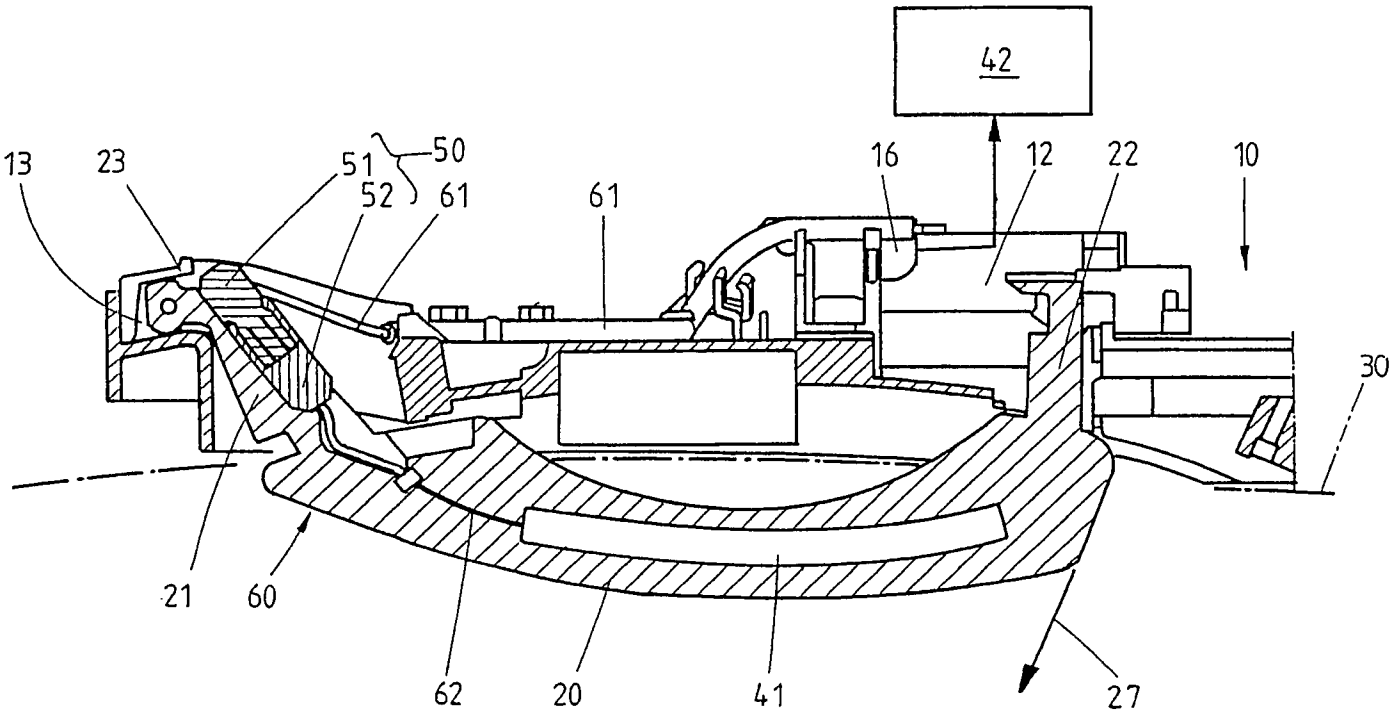
FIG. 8, in analogy to FIG. 1, shows the corresponding longitudinal cross section after the handle has been mounted in the bracket by means of the setting movement illustrated by arrows in FIG. 6 and has arrived in its working position in the door of the vehicle.

The device includes a bracket 10, which is mounted in the interior 33 of the door behind an exterior panel 30, indicated in FIGS. 1 and 8 in dash-dot line. The exterior door panel 30 can be made up of several parts and have a shell part, which covers only the central area of the bracket 10.

The device also includes a handle 20, which can be mounted in the bracket 10 from the outside 34 of the door. For this purpose, the handle 20 has extensions 21, 22, one at each end, which fulfill different functions. The one extension 21 is provided with bearing points 23, for which reason it is referred to in the following as the "bearing extension". The other extension 22 is intended to cooperate after its installation with a lock (not shown) in the interior 33 of the door and for this purpose has a hook 24 or the like at the end.

Figure 6:
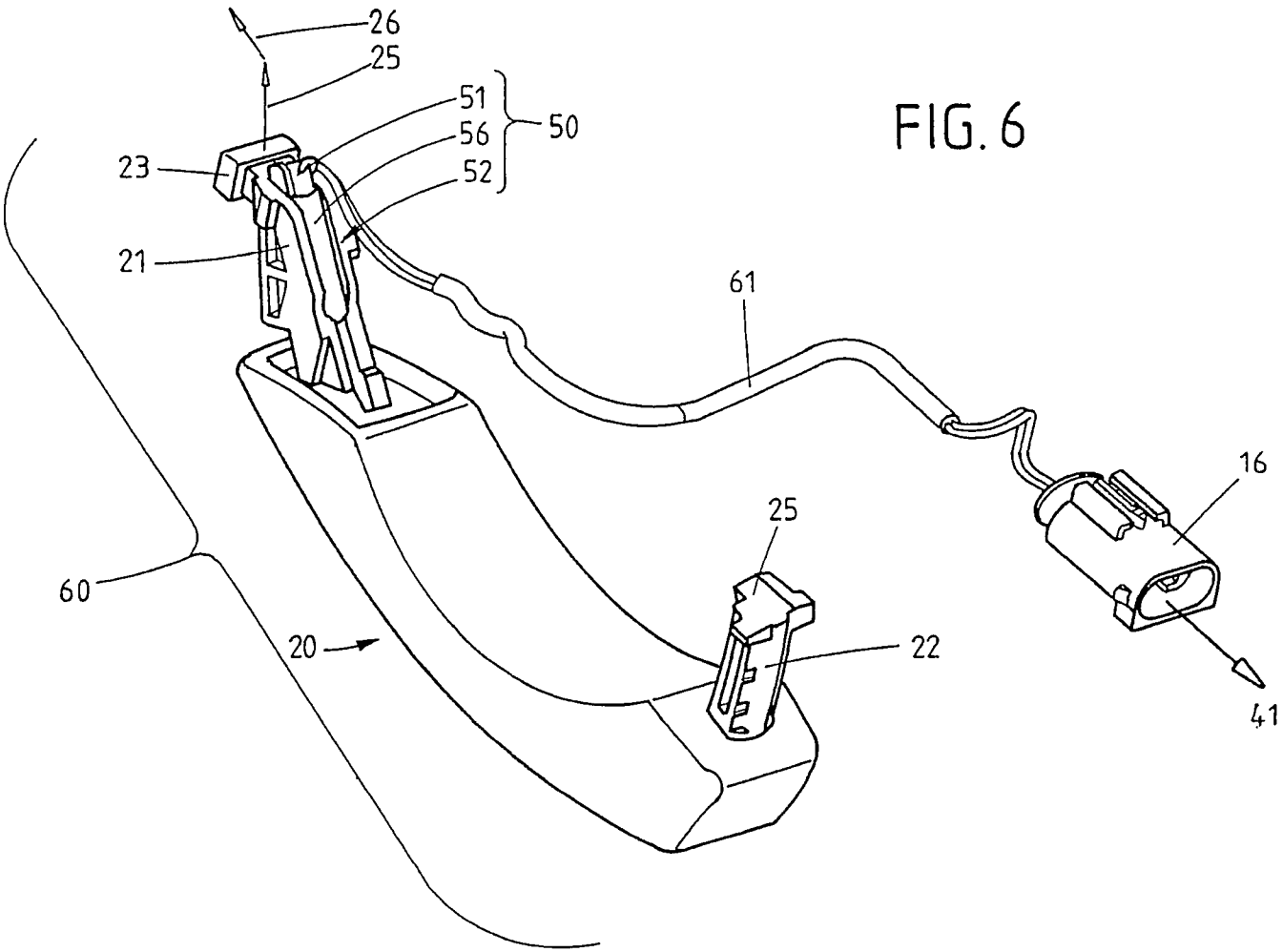
FIG. 6 is a perspective view of the completed connection between the bracket-side mating coupling part and the handle-side coupling part, where the bracket has again been omitted.
Figure 9:
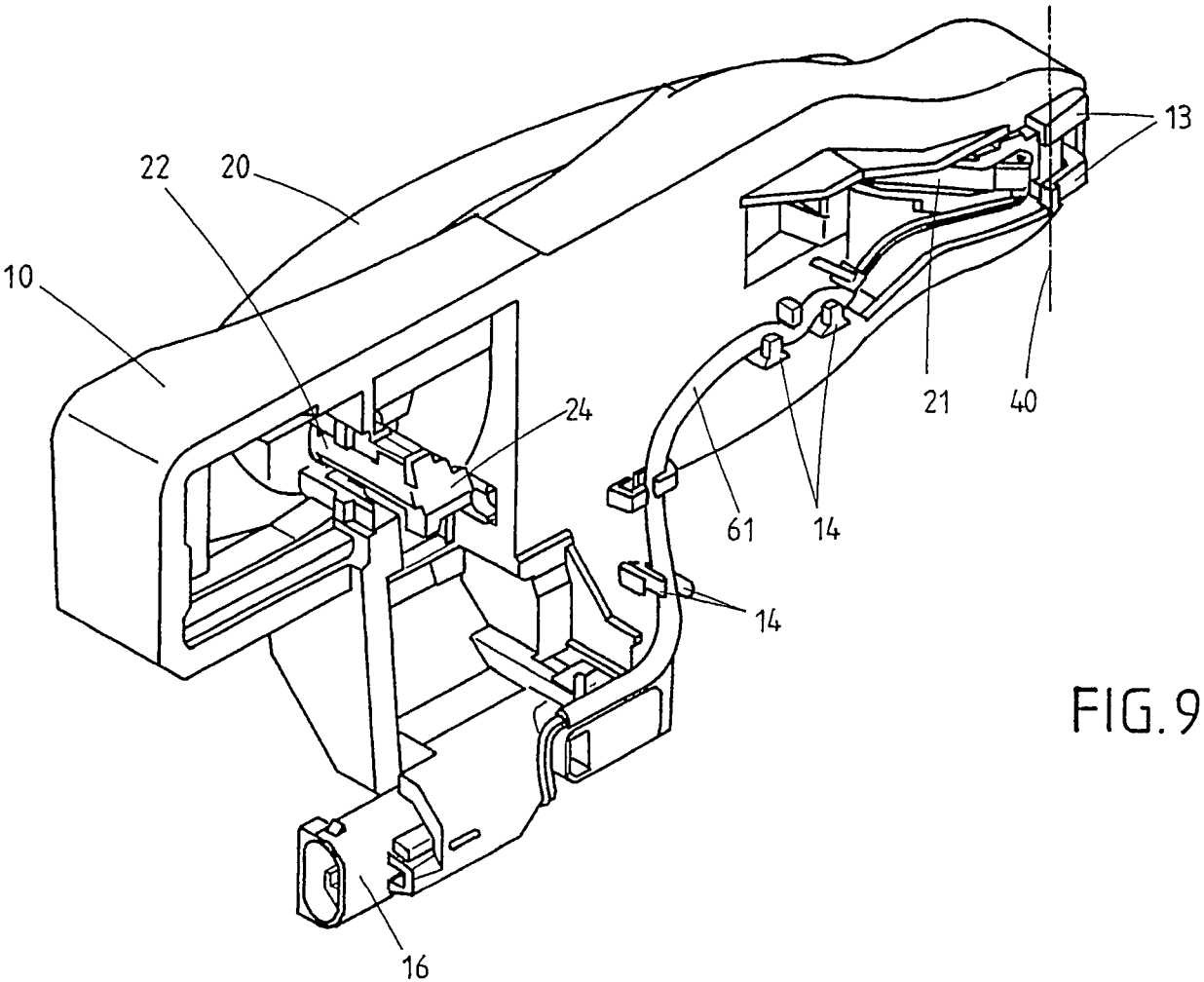
FIG. 9 is a perspective view, from the rear, of the installed device according to the invention, the exterior panel having been omitted, as a result of which it is possible to see through to the handle mounted on the outside of the door.
Figure 10:
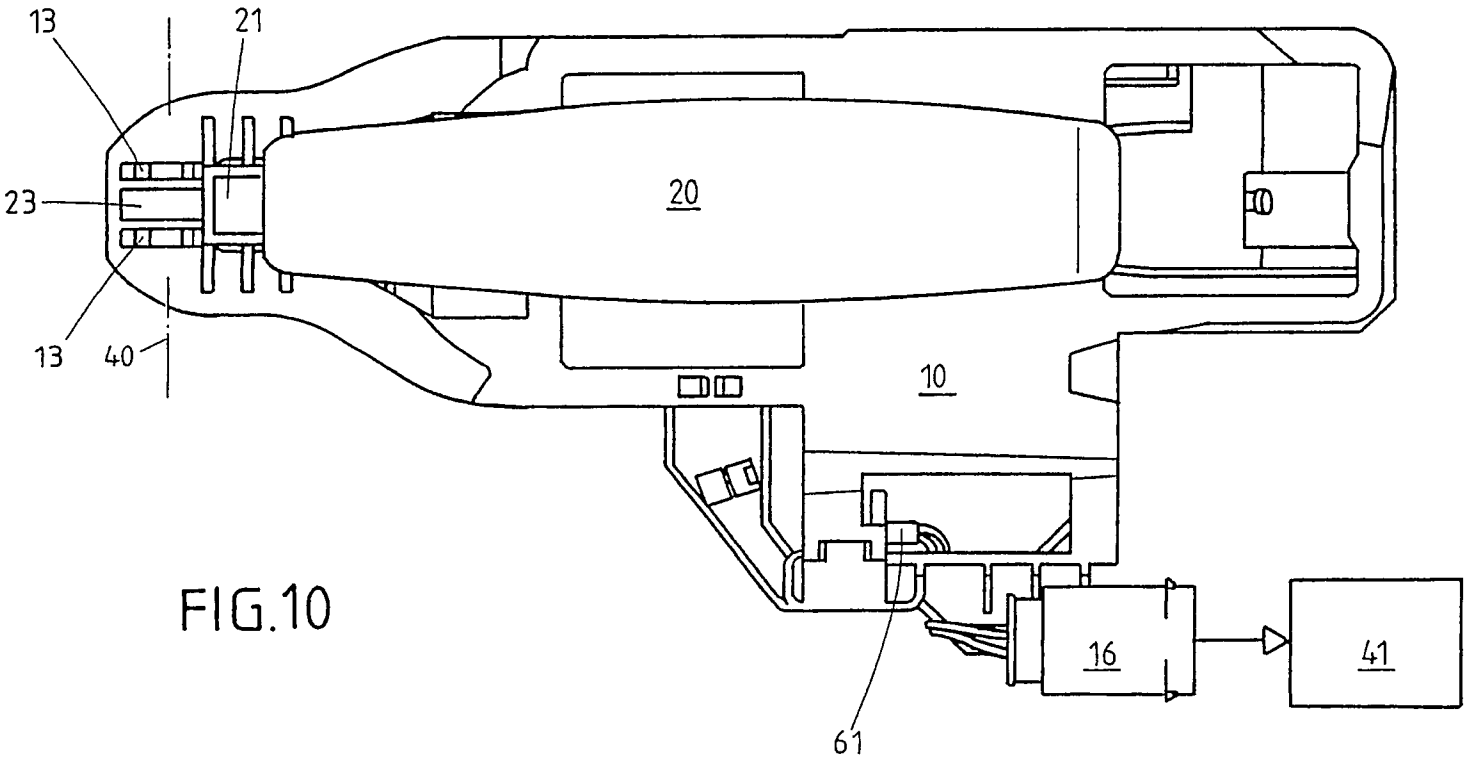
FIG. 10 is a top view of the external side of the completed inventive device, the external panel again having been omitted.

The handle is installed with the help of two openings 31, 32, through which the two extensions 21, 22 are inserted during the installation process. The installation process comprises several phases, which can be described as a setting movement in the area of the bearing extension 21. This movement is illustrated in FIG. 6 by two motion arrows 25, 26. It consists of an insertion phase, illustrated by the arrow 25, during which the bearing extension 21 of the handle 20 passes through the panel opening 31 and arrives in a first recess 11 in the bracket. In a similar manner, the other handle extension 22 passes through the second panel opening 32 and arrives in a similar recess 12 in the bracket 10. After the insertion 25 phase, there follows a transversely directed displacement phase in the direction indicated by the arrow 26 in FIG. 6, as a result of which the handle-side bearing point 23 arrives in a mating bearing point 13 in the bracket 10. This end position is shown in FIGS. 8 and 10. Now the bearing point 23 and the mating bearing point 13 determine a pivot axis 40 for the handle 20 as shown in FIG. 7 and FIGS. 9-10. When the installed handle 20 is actuated, it pivots in the direction of the arrow 27 of FIG. 8.

The device, however, allows not only a mechanical actuation of the lock by way of the handle 20, in which, as previously mentioned, the other handle extension 22 also participates, but also an especially convenient electrical control function, which operates with two parts 41, 42. The control unit 42, indicated schematically in FIG. 1, is in the handle 20, and the other control unit 41, also illustrated schematically in FIG. 1, is installed in the vehicle. When in use, according to FIG. 8, these two parts 41, 42 of the control unit are connected to each other by electrical wiring, which consists for its own part of two sections 61, 62, which can be seen in FIG. 8. The one section 61, as can be seen best in FIG. 9, is laid in the bracket 10, for which purpose various retaining means 14 are provided there. The other section 62 passes through the handle 20, as can be seen in FIG. 1. The two wiring sections 61, 62 are, when in use as shown in FIG. 8, connected by a two-part electrical coupling 50, which is designed in the following special way.

Figure 2A:
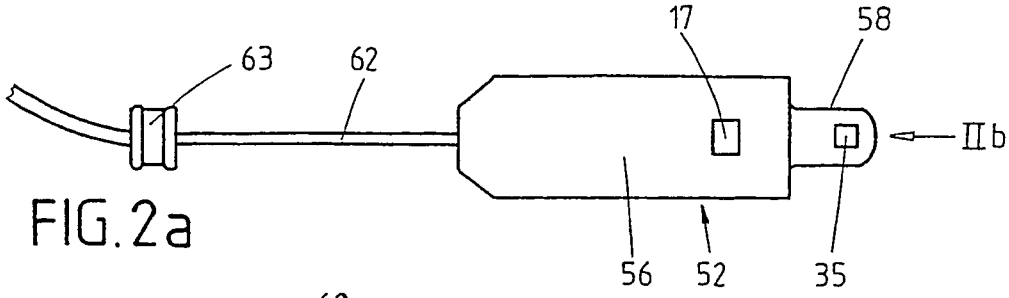
FIG. 2*a* is an enlarged side view of the coupling part before it is installed in the handle.
Figure 2B:
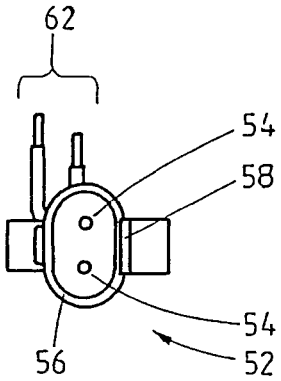
FIG. 2*b* is an end view of the coupling part of FIG. 2*a*, looking in the direction of arrow IIb.

As can be seen most clearly in FIGS. 2*a* and 2*b*, a coupling part 52 is located on the wiring section 62; this coupling part has electrical plug connector contacts 54 in the interior of a protective sleeve 56. The protective sleeve 56 has a tab 68, which extends outward beyond the area of the opening in the end of the sleeve. A hole 35 is provided at the end of the tab.

Figure 5:
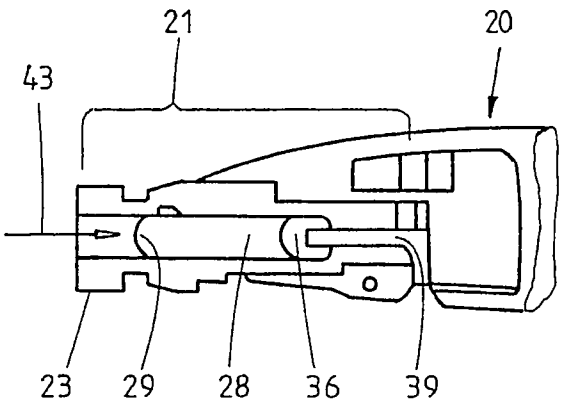
FIG. 5 is a top view corresponding to FIG. 4 of the end of the handle before the electrical coupling part already shown in FIG. 4 is inserted into it.
Figure 7B:
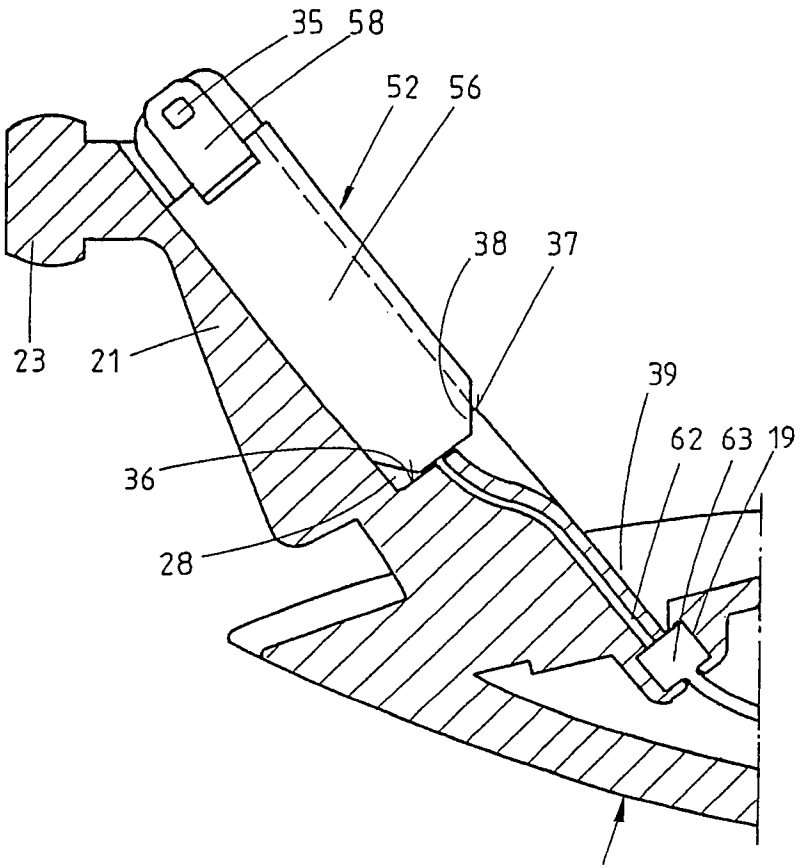
FIG. 7*b*, in analogy to FIG. 7*a*, shows a horizontal cross section through the bearing extension of the handle.

As can be seen most clearly in FIG. 5, a receptacle 28 is formed in the bearing extension 21 of the handle 20; in the present case, this receptacle is designed in the form of a pocket. The pocket 28 is open toward the bearing point 23 and has there a pocket opening 29. The pocket, as shown in the top view of FIG. 5, is slotted in the longitudinal direction. When the coupling part 52 is inserted into the pocket 28, the housing sleeve 56 of the coupling part 57, as FIGS. 6 and 7*b* show, projects out to a certain extent but is seated in the pocket in such a way that it cannot escape. The bottom 36 of the pocket shown in FIG. 5 is, as can be derived from FIG. 7*b*, provided with an undercut 37, which grips the inner end 38 of the housing 56 after insertion. As a result, the inserted coupling part 52 is captured in the pocket 28. After the coupling part 52 has been inserted, the associated section of wiring is laid in an extension 39 of the pocket, the course of which is very easy to see in FIGS. 5 and 7*b*. In the pocket extension there is also a hollow space 19, into which, during the insertion and laying process, a profile piece 63, as can be seen best in FIG. 2*a* but also in FIG. 7*b*, comes to rest.

Figure 4:
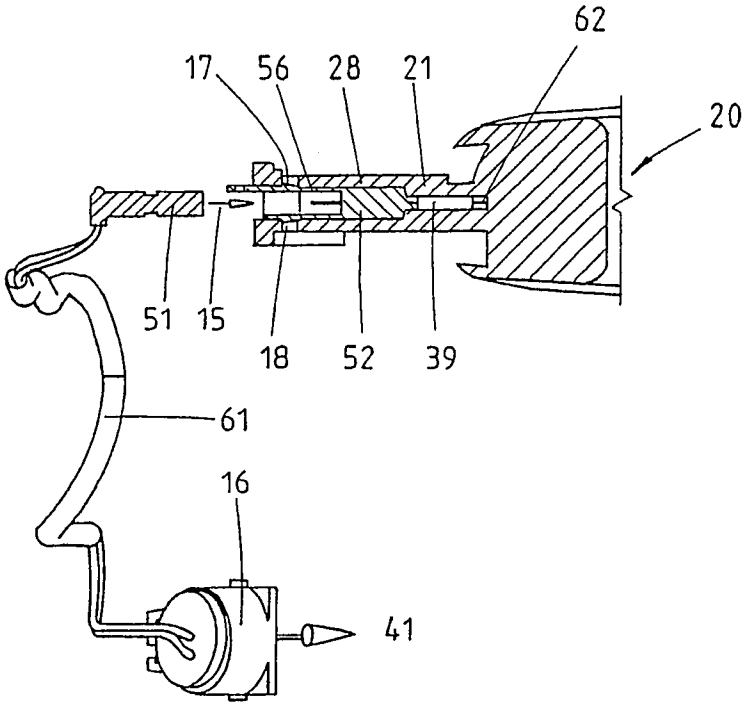
FIG. 4 is a cross-sectional view along line IV-IV in FIG. 1 of the assemblies shown in that figure, which are still disconnected from each other, where the bracket has been omitted and only its associated section of wiring with the mating coupling part is shown.

The inserted position of the coupling part 52 in the pocket 27 is secured by a latch fastening 17, 18. For this purpose, as can be seen especially well in FIG. 7*a*, the housing 56 has a pair of diametrically opposing clip tabs 17, which have a ramp extending in the insertion direction 43 of FIG. 5. During insertion in the direction of arrow 43 of FIGS. 5 and 7*a*, the sleeve-shaped housing area gives way, and the clip tabs 17 travel into recesses 18 provided in the sidewalls of the bearing part 21 of the handle 20. When the mating coupling part 51 is inserted for connection in the direction of the arrow 15 of FIGS. 1 and 4, the sleeve part of the housing 56 is stiffened and thus the engagement 17 of the clip tabs 17 in the handle recesses 18 is secured. The coupling part 52 is captured permanently in the handle.

Figure 3A:
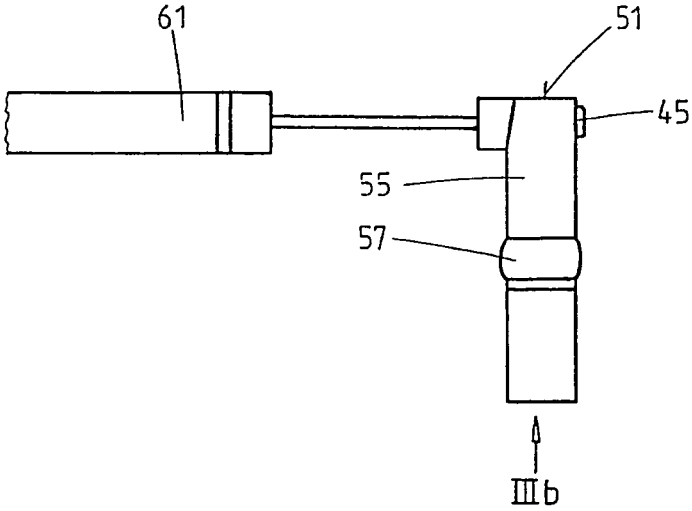
FIG. 3*a* shows the mating coupling part cooperating with the coupling part of FIGS. 2*a* and 2*b*, the associated wiring section, which is a component of the bracket, also being shown.
Figure 3B:
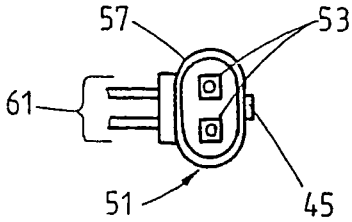
FIG. 3*b*, in analogy to FIG. 2*b*, is an end view of the mating coupling part of FIG. 3*a*, looking in the direction of arrow 111*b* in that figure.

As FIG. 3*a* illustrates, the mating coupling part 51 extends essentially at a right angle to the extended course of the associated wiring section 61. So that electrical contact can be established, the coupling part, as FIG. 3*b* reveals, has female contacts 53. Its housing 55 is designed in the form of a sleeve corresponding to the oval cross section of the housing sleeve 56 belonging to the coupling part 56. In an annular zone of the sleeve-like housing 55, a circumferential sealing ring 57 is positioned, which, after the connecting movement 15, is supported against the inside wall of the housing sleeve 56. This contributes to the previously described stiffening of the housing sleeve and to the securing of its inserted position in the handle.

Figure 7A:
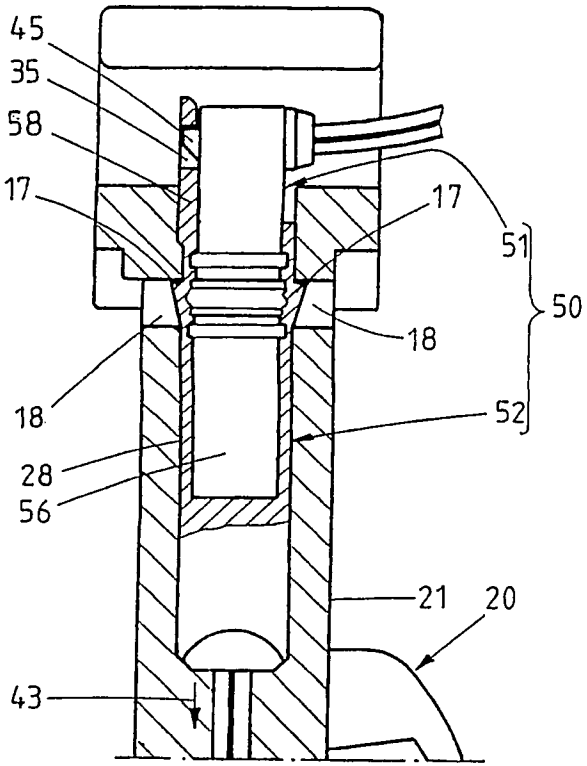
FIG. 7*a* shows a vertical cross section through the handle according to FIG. 6 in the area of its bearing extension and the bearing points after the electrical coupling part and the mating coupling part have been fitted together.

The electrical contact-producing engagement between the coupling part 52 and the mating coupling part 51 is also locked in place. For this purpose, a locking arrangement 35, 45 is used, which consists of the previously described hole 35 in the housing tab 58 and a locking projection 45 in the housing sleeve 55 of the mating coupling part 51. The tab 58 bends elastically outward until the locking projection 45 snaps into the hole 35 and then, as FIG. 7*a* illustrates, grips the upper edge of the hole. This has the effect of locking the connection 50 in its engaged position. To disengage the parts 51, 52, the tab 58 must first be manually bent back until the locking projection 45 is released from the hole 35. Then the two parts 51, 52 can be pulled out in the direction opposite that of the arrow 15 in FIG. 1. The coupling part 52 remains held in place initially in its pocket 29.

The mounted coupling part 52 is located in a unique, fixed end position in the handle 20 according to FIG. 1. The end of the other wiring section 61 on the bracket side projects out through the opening 31 in the panel; the mating electrical coupling part 51 of the previously mentioned two-part coupling 50 shown in FIG. 8 is seated on the outer end of this wiring section. Before the installation of the handle 20 begins as previously described, the mating coupling part 51 is inserted in the direction of the arrow 15 shown in FIG. 1 through the pocket opening 29 and into the sleeve opening of the housing 56 belonging to the coupling part 52. This is shown in FIG. 6. The two wiring sections 61, 62 are therefore in contact with each other via the electrical coupling 50, as a result of which, even before installation of the handle 20 begins, the handle-side control unit 52 is already connected electrically to the other control unit 51 assigned to the vehicle. In the exemplary embodiment, the wiring section 61 is provided with an electrical connecting piece 16 at the end of the bracket. This connecting piece leads via opposing coupling pieces (not shown) and wiring to the other control unit 41 in the vehicle.

After the connection has been established, the handle, the coupling part 52 held inside it, and the mating coupling part 51 connected to the first coupling part form, as FIG. 6 shows, a solid structural unit 60, all the components of which can move in common. The structural unit 60 is then mounted in the recesses 11, 17 of the bracket by means of the setting movement 25, 26 described previously. As a result, the device arrives in its working position, as described above in conjunction with FIG. 8. When now, as already described in conjunction with FIG. 7, the handle 20 is subjected to the pivoting movement 27, the entire unit 60 is moved around the common pivot axis 40, which is the natural pivot axis of the handle 20. The two parts 51, 52 of the coupling 50 are carried along during the actuation 27 of the handle 20; the pivot axis 14 Page of the handle is simultaneously the axis of rotation of the coupling 50.

While specific embodiments of the invention have been shown and described in detail to illustrate the inventive principles, it will be understood that the invention may be embodied otherwise without departing from such principles.

We claim:

1. An assembly comprised of a device arranged on a door or a hatch of a motor vehicle for actuating a lock installed in the door or the hatch, the device comprising a manually actuatable handle (20) on an exterior (34) of the door, the handle having a bearing extension (21) with bearing points (23) at one end thereof;

a bracket (10) mounted in the interior (33) of the door, the bracket being provided with mating bearing points (13) for the bearing points (23) of the handle (20);

a two-part electrical control unit (41, 42), having one control unit and an other control unit, for the lock, the one control unit (42) being integrated into the handle (20) and connected to the other control unit (41) located in the vehicle by means of electrical wiring (61, 62);

a two-part electrical coupling (50) located between two sections (61, 62) of the electrical wiring, the coupling consisting of a coupling part (52) connected to the control unit (42) on a handle side and a mating coupling part (51) assigned to the other control unit (41) on a vehicle side;

wherein the bearing extension (21) of the handle (20) is insertable from the exterior (34) of the door through an opening (31) in an exterior panel (30) of the door and the bearing points (23) mounted (25, 26) in mating bearing points (31) of the bracket (10);

as a result of which the bearing points (23) and the mating bearing points (13) define a pivot axis (40) in the bracket (10) for actuation (27) of the handle (20), wherein, prior to coupling (15), the coupling part (52) is immovably fixed in a receptacle (28) of the bearing extension (21) of the handle (20), and the mating coupling part (51) together with the section (61) of wiring freely hangs out of an opening (31) in an exterior surface of the exterior panel (30) of the door wherein, prior to the mounting of the handle (20),the mating coupling part (51) is configured to be manually connectable into the coupling part (52) from the exterior (34) of the exterior panel (30) and outside the door, and, still prior to mounting the handle, the electrically connected coupling part (52) and the mating coupling part (51) form a solid structural unit (60) with the handle (20) as well as a continuous electrical wiring of the two sections (61, 62); and wherein the entire structural unit (60) is movable through the opening (31) from the exterior (34) to the interior (33) of the door so as to mount (25, 26) the handle (20 of the structural unit (60) in the bracket (10).

2. The assembly according to claim 1, wherein the receptacle is a molded pocket (28), into which the coupling part (52) of the handle (20) can be inserted (43); and the section (62) of wiring leading to the control unit (42) in the handle is laid in an extension (39) of the pocket (28).

3. The assembly according to claim 2, wherein the pocket (28) is open at the end facing the bearing point (23) and has an opening (29) for the engagement (15) of the mating coupling part (51).

4. The assembly according to claim 2, wherein the pocket (28) is slotted longitudinally, the inserted coupling part (52) thus projecting out of the longitudinal slot to some extent; and wherein an undercut (37) is formed in the bottom (36) of the pocket facing away from the opening (39), the undercut (37) being engaged by the inner end (38) of the inserted coupling part (52).

5. The assembly according to claim 1, wherein one of the locking elements comprises at least one clip tab (17);

whereas the mating locking element has at least one opening (18), into which the clip tab (17) latches in the inserted position.

6. The assembly according to claim 1, wherein the coupling part (52) on the one side and the mating coupling part (51) on the other side have elements (35, 45) of a latching arrangement which are complementary to each other and which, after the connection has been established, are in engagement with each other and secure the engagement of the coupling part (52) with the mating coupling part (51).

* * * * *